US007482980B2

(12) United States Patent
Huang et al.

(10) Patent No.: US 7,482,980 B2
(45) Date of Patent: Jan. 27, 2009

(54) THREE-DIMENSIONAL WIDEBAND ANTENNA AND RELATED WIRELESS COMMUNICATION DEVICE

(75) Inventors: Jiunn-Ming Huang, Taipei Hsien (TW); Chih-Ming Wang, Taipei Hsien (TW); Feng-Chi Eddie Tsai, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 96 days.

(21) Appl. No.: 11/737,146

(22) Filed: Apr. 19, 2007

(65) Prior Publication Data

US 2008/0150833 A1 Jun. 26, 2008

(30) Foreign Application Priority Data

Dec. 22, 2006 (TW) ..... 95148343 A

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 4,511,898 A * 4/1985 Bush ..... 343/736
5,200,756 A * 4/1993 Feller ..... 343/700 MS

* cited by examiner

*Primary Examiner*—Hoang V Nguyen
(74) *Attorney, Agent, or Firm*—Winston Hsu

(57) ABSTRACT

A wideband antenna includes a substrate, a radiator, a signal feeding element, and a grounding element. The radiator includes a first child radiator and a second child radiator. The first child radiator and the second child radiator both include a respective first end and a second end. The signal feeding element is connected between the substrate and the first end of the first child radiator. The grounding element is connected between the substrate and the first end of the second child radiator. The first child radiator and the second child radiator form an inverted V-shape installed on the substrate.

30 Claims, 26 Drawing Sheets

XZ plane

| Frequency | Maximum value | Position | Minimum value | Position | Average |
|---|---|---|---|---|---|
| 2400 (MHz) | 3.92 dB | -42.00 deg | -17.68 dB | -177.00 deg | -2.48 dB |
| 2450 (MHz) | 3.75 dB | -45.00 deg | -17.19 dB | -177.00 deg | -2.90 dB |
| 2500 (MHz) | 4.31 dB | -45.00 deg | -16.07 dB | -174.00 deg | -2.21 dB |

Fig. 18

XZ plane

| Frequency | Maximum value | Position | Minimum value | Position | Average |
|---|---|---|---|---|---|
| 4900 (MHz) | 5.64 dB | -51.00 deg | -20.00 dB | -150.02 deg | -0.90 dB |
| 5150 (MHz) | 5.22 dB | -48.00 deg | -22.51 dB | -179.76 deg | -1.50 dB |
| 5250 (MHz) | 4.93 dB | -45.00 deg | -20.69 dB | -150.02 deg | -1.57 dB |
| 5350 (MHz) | 5.12 dB | -45.00 deg | -20.14 dB | 177.01 deg | -1.39 dB |
| 5470 (MHz) | 4.81 dB | -45.00 deg | -21.58 dB | -150.02 deg | -1.74 dB |
| 5600 (MHz) | 4.48 dB | 3.00 deg | -20.58 dB | 158.99 deg | -2.38 dB |
| 5725 (MHz) | 4.45 dB | -6.00 deg | -21.09 dB | 132.01 deg | -2.74 dB |
| 5850 (MHz) | 5.30 dB | 3.00 deg | -20.68 dB | -150.02 deg | -2.28 dB |

Fig. 20

THREE-DIMENSIONAL WIDEBAND ANTENNA AND RELATED WIRELESS COMMUNICATION DEVICE

BACKGROUND OF THE INVENTION

1. Field of the Invention

The present invention relates to a three-dimensional wideband antenna and related wireless communication device, and more particularly, to a three-dimensional wideband antenna and related wireless communication device having a metal sheet with an inverted V-shape installed on a substrate.

2. Description of the Prior Art

As wireless telecommunication develops with the trend of micro-sized mobile communication products, the location and the space arranged for antennas are limited. Therefore, some built-in micro antennas have been developed. Currently, micro antennas such as chip antennas, planar antennas etc are commonly used. All these antennas have the feature of small volume. Additionally, planar antennas are also designed in many types such as micro-strip antennas, printed antennas and planar inverted F antennas. These antennas are widespread, being applied to GSM, DCS, UMTS, WLAN, Bluetooth, etc.

With the improvement of data transmission speed in wireless communication systems, multi-frequency or wideband antennas have become a basic requirement of communication systems. How to reduce sizes of the antennas, improve antenna efficiency, and improve impedance matching becomes an important consideration in the field. Cost of conventional wideband antennas is unable to be reduced effectively, and their radiation patterns and operational frequency are difficult to control, restricting their application ranges.

SUMMARY OF THE INVENTION

A three-dimensional wideband antenna is disclosed in an exemplary embodiment of the present invention. The wideband antenna includes a substrate, a radiator, a signal feeding element, and a grounding element. The radiator includes a first child radiator and a second child radiator. The first child radiator and the second child radiator both include a respective first end and second end, where the second end of the second child radiator is connected to the second end of the first child radiator. The signal feeding element is connected between the substrate and the first end of the first child radiator. The grounding element is connected between the substrate and the first end of the second child radiator. The first child radiator and the second child radiator are formed into an inverted V-shape and installed on the substrate. The first child radiator approximates to a tapered width plane, and a width of the first end of the first child radiator is smaller than a width of the second end of the first child radiator. The second child radiator approximates to a tapered width plane, and a width of the first end of the second child radiator is smaller than a width of the second end of the second child radiator. The first child radiator and the second child radiator are both formed by bending a rhombus metal sheet along a diagonal of the rhombus metal sheet.

A wireless communication device with three-dimensional wideband antennas according to another exemplary embodiment of the present invention is disclosed. The wireless communication device includes a system circuit and a plurality of wideband antennas. Each wideband antenna includes a substrate, a radiator, a signal feeding element, and a grounding element. The radiator includes a first child radiator and a second child radiator. The first child radiator and the second child radiator both include a respective first end and a second end, where the second end of the second child radiator is connected to the second end of the first child radiator. The signal feeding element is connected between the substrate and the first end of the first child radiator. The grounding element is connected between the substrate and the first end of the second child radiator. The first child radiator and the second child radiator are formed into an inverted V-shape and installed on the substrate. The first child radiator approximates to a tapered width plane, and a width of the first end of the first child radiator is smaller than a width of the second end of the first child radiator. The second child radiator approximates to a tapered width plane, and a width of the first end of the second child radiator is smaller than a width of the second end of the second child radiator. The first child radiator and the second child radiator are both formed by bending a rhombus metal sheet along a diagonal of the rhombus metal sheet. The wireless communication device is a wireless access point, having three antennas. One arrangement manner of the three wideband antennas located inside the wireless communication device is a connection line of three center points of the three wideband antennas, thereby constructing a triangle. Another arrangement manner of the three wideband antennas located inside the wireless communication device is a connection line of three center points of the three wideband antennas, thereby constructing a straight line.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

FIG. 18 is a diagram showing the positions and the values of the maximum values and the minimum values in FIG. 17.

FIG. 20 is a diagram showing the positions and the values of the maximum values and the minimum values in FIG. 1 9.

DETAILED DESCRIPTION

Figure 1:
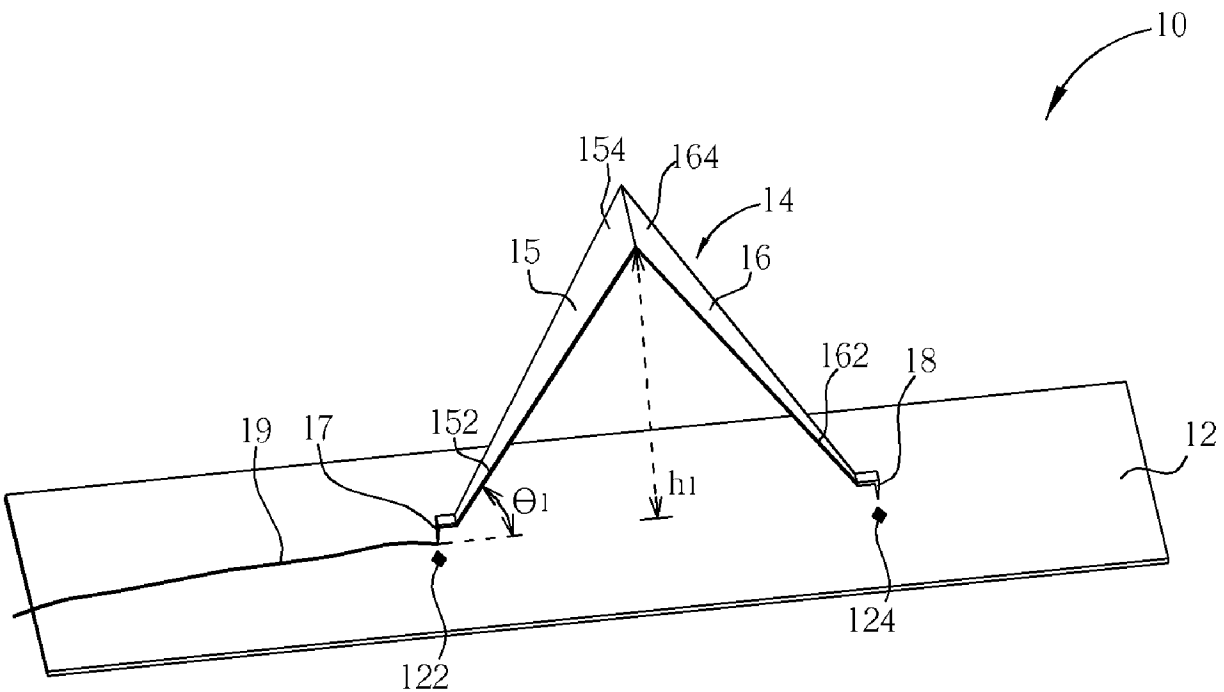
FIG. 1 is a diagram of a three-dimensional wideband antenna according to an embodiment of the present invention.

Please refer to FIG. 1, which is a diagram of a three-dimensional wideband antenna 10 according to an embodiment of the present invention. The wideband antenna 10 includes a substrate 12, a radiator 14, a signal feeding element 17, and a grounding element 18. The substrate 12 includes a signal feeding point 122 and a grounding point 124. The radiator 14 includes a first child radiator 15 and a second child radiator 16. The first child radiator 15 has a first end 152 and a second end 154. The second child radiator 16 has a first end 162 and a second end 164, where the second end 164 of the second child radiator 16 is connected to the second end 154 of the first child radiator 15. The signal feeding element 17 is connected between the signal feeding point 122 and the first end 152 of the first child radiator 15. The grounding element 18 is connected between the grounding point 124 and the first end 162 of the second child radiator 16. The signal feeding element 17 is connected to a signal line 19 for receiving an input signal. Preferably, the first child radiator 15 and the second child radiator 16 are substantially composed of a single metal sheet. In this embodiment, the first child radiator 15 and the second child radiator 16 are formed by bending a rhombus metal sheet along a diagonal of the rhombus metal sheet, which forms the first child radiator 15 and the second child radiator 16 into an inverted V-shape installed on the substrate 12. An angle between the first end 152 of the first child radiator 15 and the substrate 12 is a first angle $\theta_1$, and a distance between the second end 154 of the first child radiator 15 and the substrate 12 is a first height $h_1$. The present invention can adjust operational frequencies and radiation patterns of the wideband antenna 10 by changing the first angle $\theta_1$ and the first height $h_1$, and this will be explained in the following. The substrate 12 comprises dielectric material and is connected to a system ground terminal electrically. Preferably, the substrate 12 is a thin metal plane. The wideband antenna 10 is installed inside a wireless communication device, such as a wireless access point (WAP).

Figure 2:
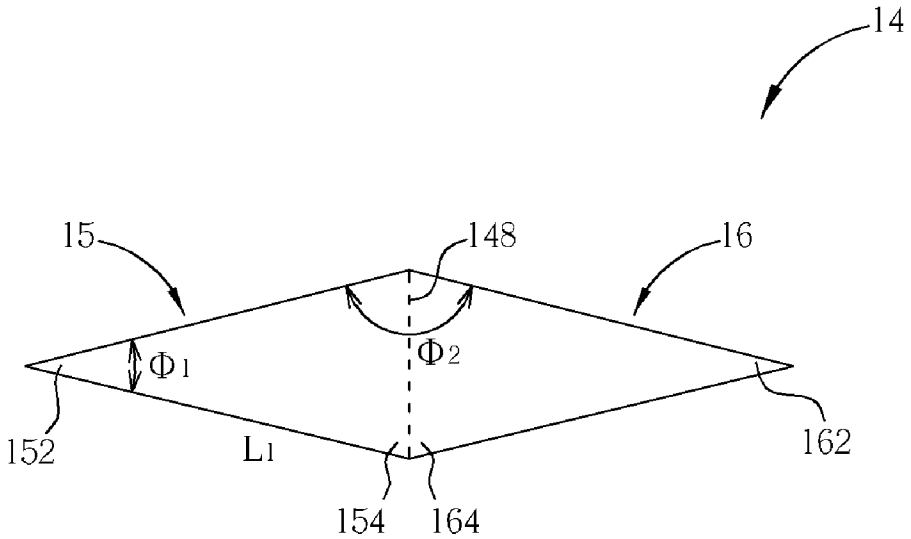
FIG. 2 is a diagram illustrating the radiator of the wideband antenna in FIG. 1.

Please refer to FIG. 2 and FIG. 1. FIG. 2 is a diagram illustrating the radiator 14 of the wideband antenna 10 in FIG. 1. The radiator 14 is a rhombus metal sheet, and the first child radiator 15 and the second child radiator 16 are formed by bending the rhombus metal sheet along a diagonal 148 of the rhombus metal sheet. Hence, the first child radiator 15 and the second child radiator 16 are each approximately a tapered width plane, whereof a width of the first end 152 of the first child radiator 15 is smaller than a width of the second end 154 of the first child radiator 15 and a width of the first end 162 of the second child radiator 16 is smaller than a width of the second end 164 of the second child radiator 16. An edge length of the rhombus metal sheet is a first length $L_1$, a first interior angle $\phi_1$ is formed by the two sides of the first child radiator 15, and a second interior angle $\phi_2$ is formed by one side of the first child radiator 15 and one side of the second radiator 16. In this embodiment, the first interior angle $\phi_1$ is smaller than 90 degrees and the second interior angle $\phi_2$ is greater than 90 degrees. The first length $L_1$ is approximately one quarter of a wavelength of a resonance mode generated by the wideband antenna 10.

Figure 3:
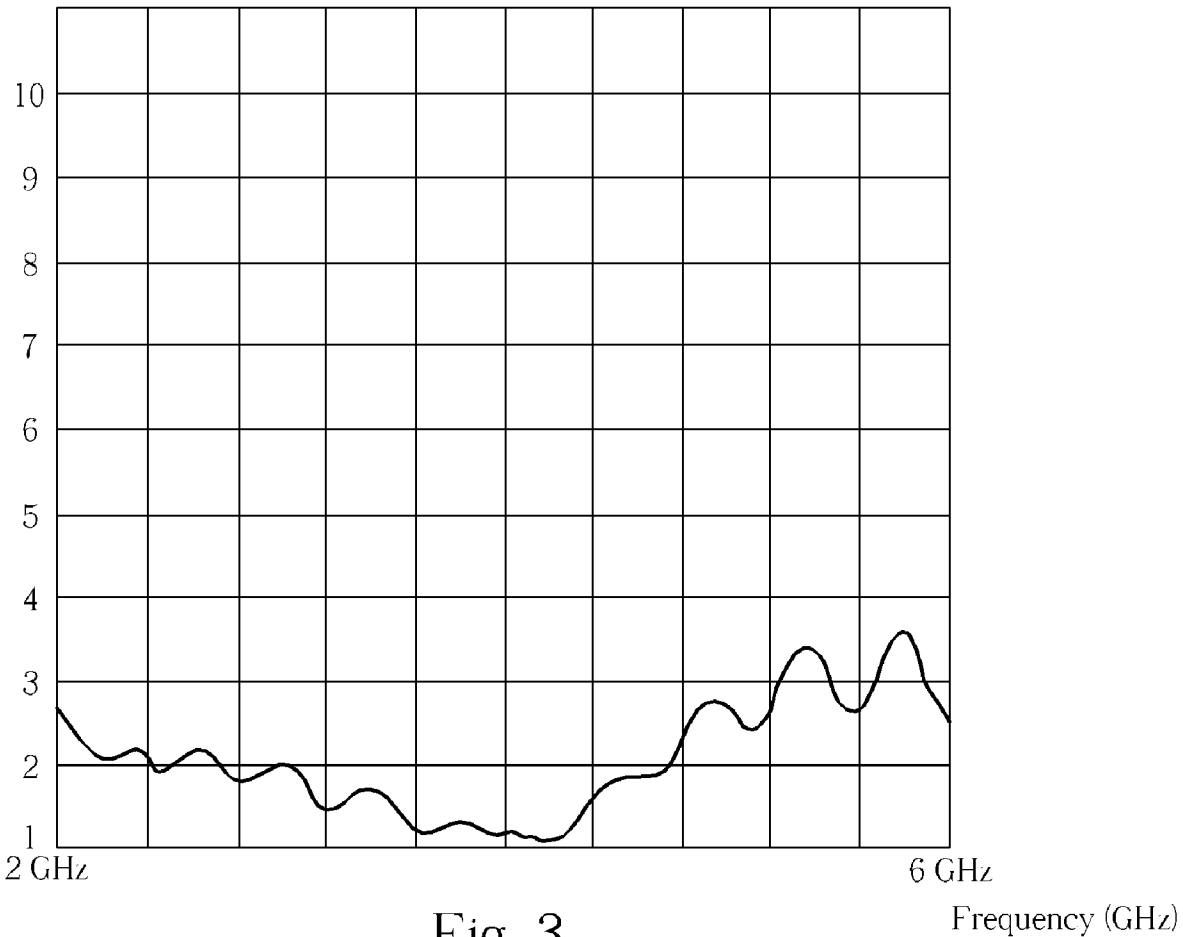
FIG. 3 is a diagram illustrating a first VSWR of the wideband antenna in FIG. 1.

Please refer to FIG. 3 and FIG. 1. FIG. 3 is a diagram illustrating a first VSWR of the wideband antenna 10 in FIG. 1. The horizontal axis represents frequency (GHz) that distributes from 2 GHz to 6 GHz, and the vertical axis represents VSWR. FIG. 3 shows the VSWR of the wideband antenna 10 when the first angle $\theta_1$ falls between 10 degrees and 30 degrees ($10° < \theta_1 < 30°$). When the VSWR is smaller than 2, the bandwidth of the wideband antenna 10 will be about 2 GHz.

Figure 4:
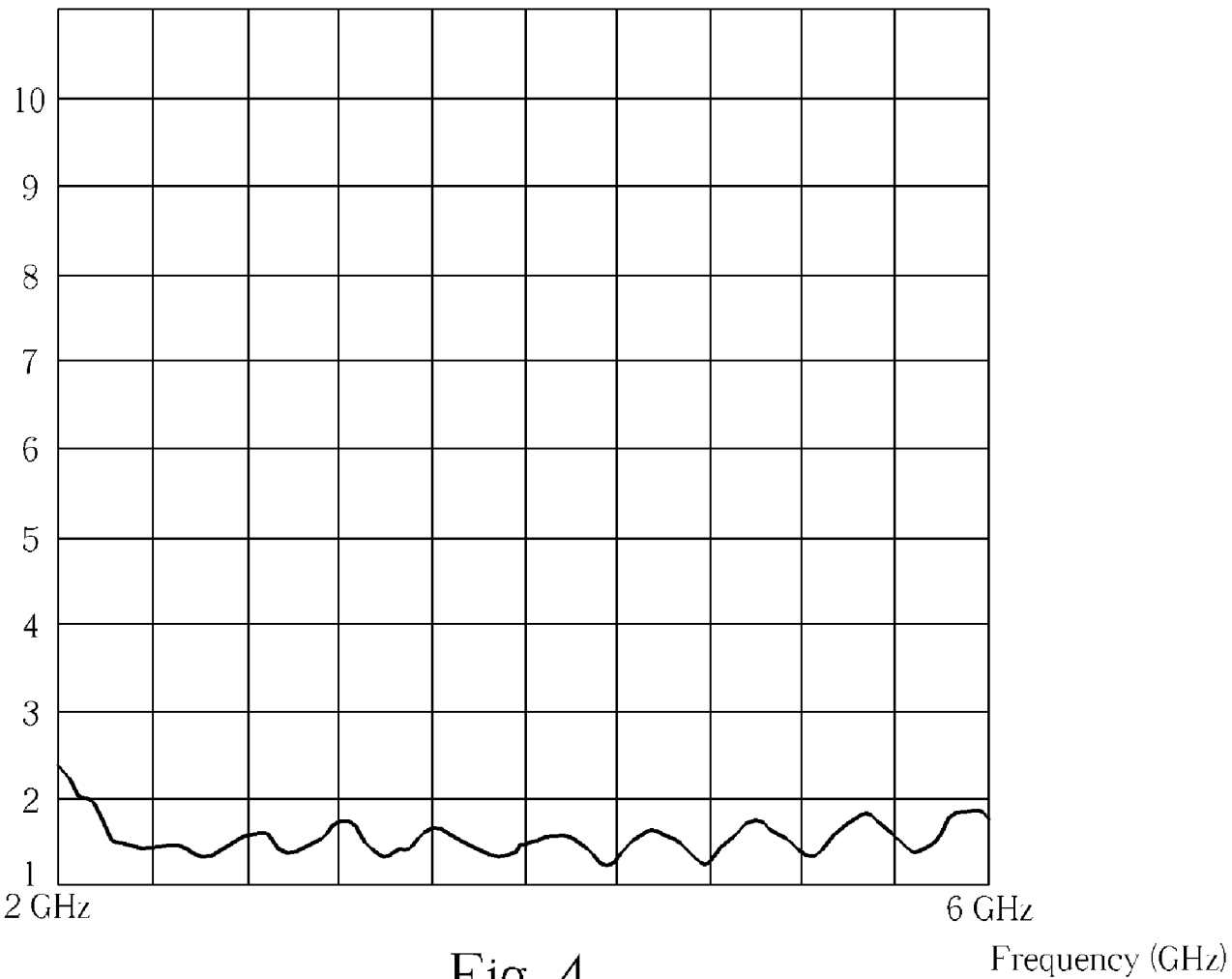
FIG. 4 is a diagram illustrating a second VSWR of the wideband antenna in FIG. 1.

Please refer to FIG. 4 and FIG. 1. FIG. 4 is a diagram illustrating a second VSWR of the wideband antenna 10 in FIG. 1. The horizontal axis represents frequency (GHz) that distributes from 2 GHz to 6 GHz, and the vertical axis represents VSWR. FIG. 4 shows the VSWR of the wideband antenna 10 when the first angle $\theta_1$ is greater than 35 degrees ($\theta_1 > 35°$). When the VSWR is smaller than 2, the bandwidth of the wideband antenna 10 will be about 4 GHz, which improves on the VSWR in FIG. 3.

Figure 5:
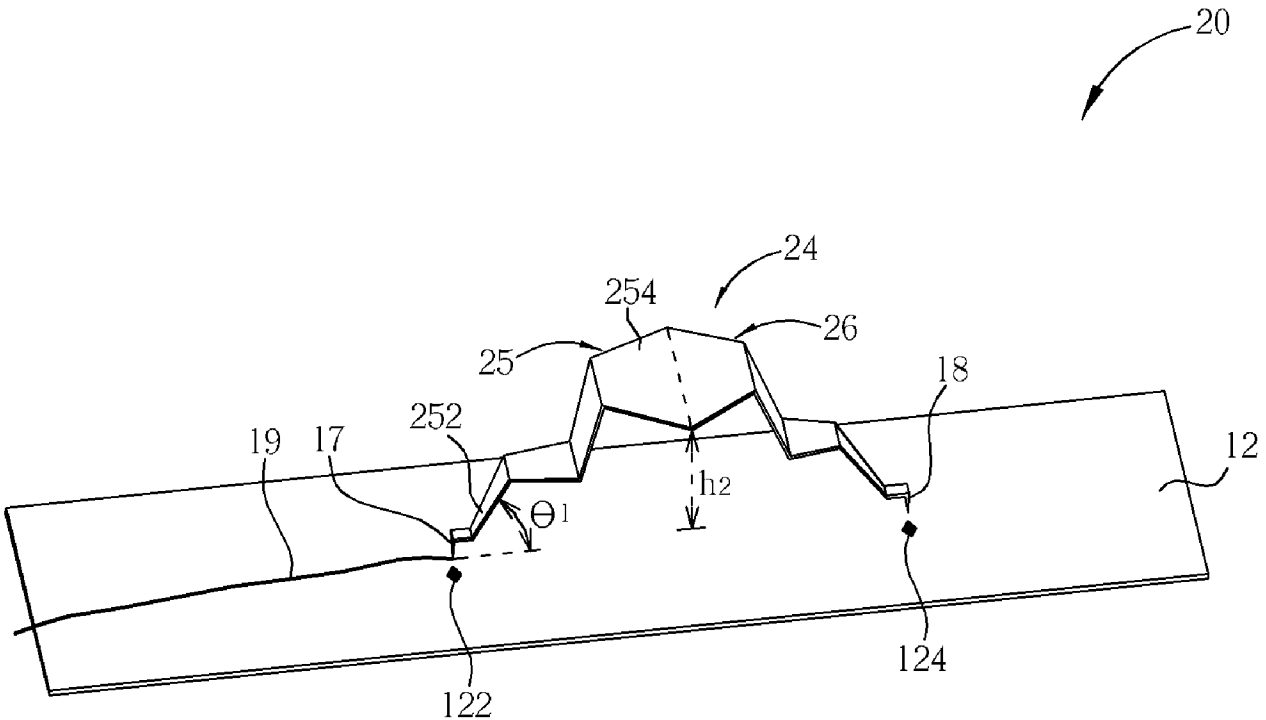
FIG. 5 is a diagram of a three-dimensional wideband antenna according to another embodiment of the present invention.
Figure 6:
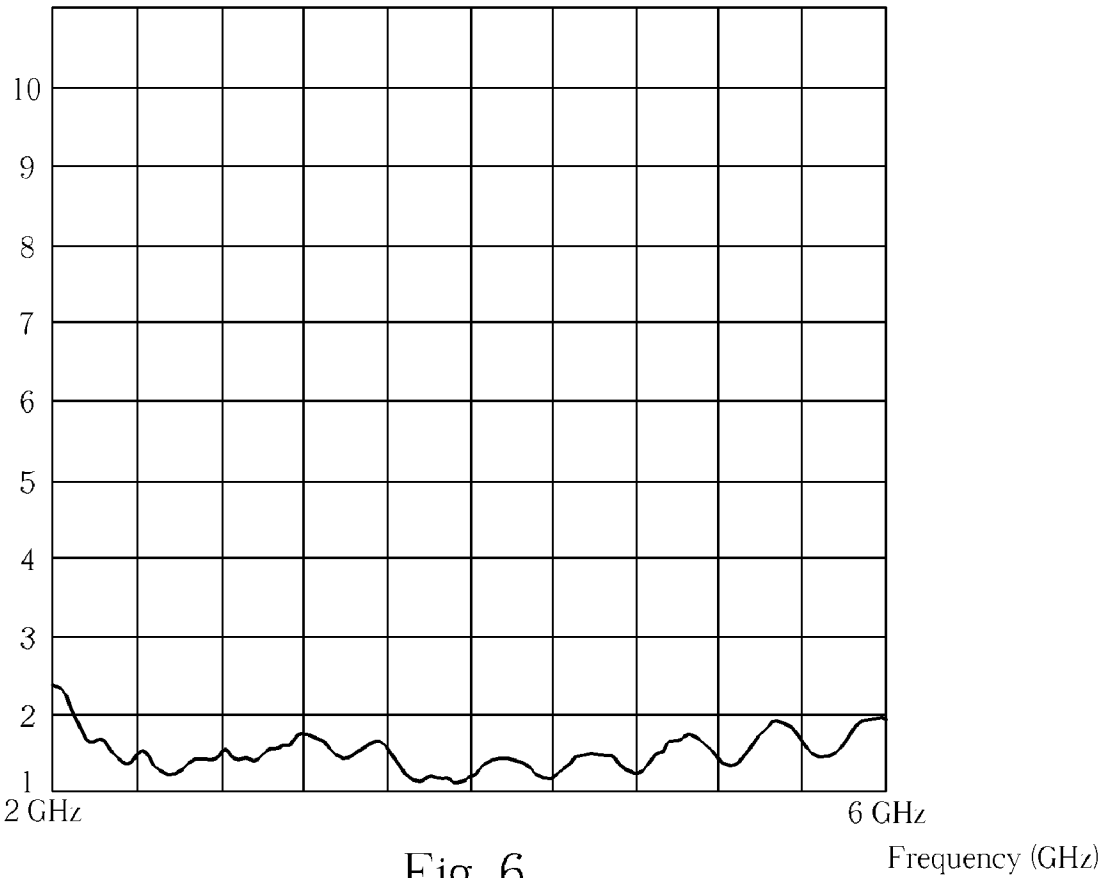
FIG. 6 is a diagram illustrating the VSWR of the wideband antenna in FIG. 5.

The wideband antenna 10 shown in FIG. 1 is merely an embodiment of the present invention, and, as is well known by a person of ordinary skill in the art, suitable variations can be applied to the wideband antenna 10. For example, several bends can be formed individually on the first child radiator 15 and the second child radiator 16. Please refer to FIG. 5 and FIG. 6. FIG. 5 is a diagram of a three-dimensional wideband antenna 20 according to another embodiment of the present invention, and FIG. 6 is a diagram illustrating the VSWR of the wideband antenna 20 in FIG. 5. The architecture of the wideband antenna 20 is similar to the wideband antenna 10 in FIG. 1, which is a changed form of the wideband antenna 10. Please note that the difference between the two structures is that a radiator 24 of the wideband antenna 20 includes a first child radiator 25 and a second child radiator 26 each including several bends. If an angle between a first end 252 of the first child radiator 25 and the substrate 12 is still the first angle $\theta_1$, a distance (a second height $h_2$) between a second end 254 of the first child radiator 25 and the substrate 12 will be smaller than the first height $h_1$ in FIG. 1 due to the first child radiator 25 and the second child radiator 26 each including several bends. In FIG. 6, the horizontal axis represents frequency (GHz) that distributes from 2 GHz to 6 GHz, and the vertical axis represents VSWR. Due to the wideband antenna 20 being the changed form of the wideband antenna 10 and the distance between the second end 254 of the first child radiator 25 and the substrate 12 being smaller than the first height $h_1$ in FIG.

1, the VSWR in FIG. 6 is different from the VSWR in FIG. 3 and in FIG. 4, wherein different VSWRs can be applied according to different system demands.

It should be noted that the bends in the first child radiator 25 and the second child radiator 26 are not limited to be a specific amount or shape.

Figure 7:
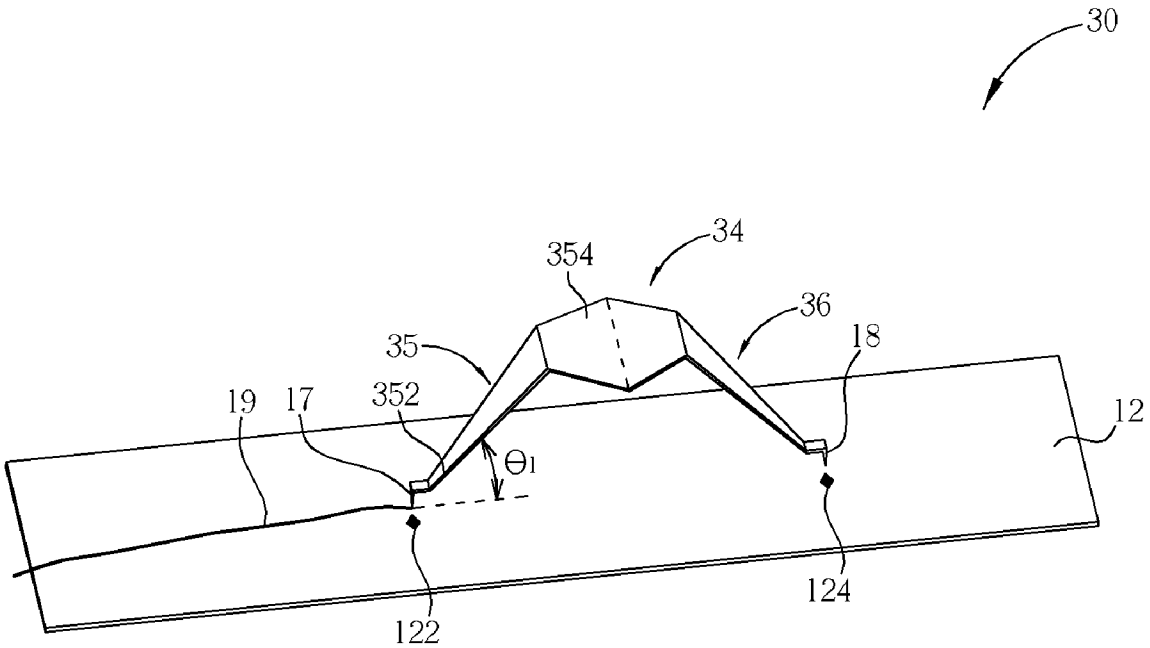
FIG. 7 is a diagram of a three-dimensional wideband antenna according to another embodiment of the present invention.
Figure 8:
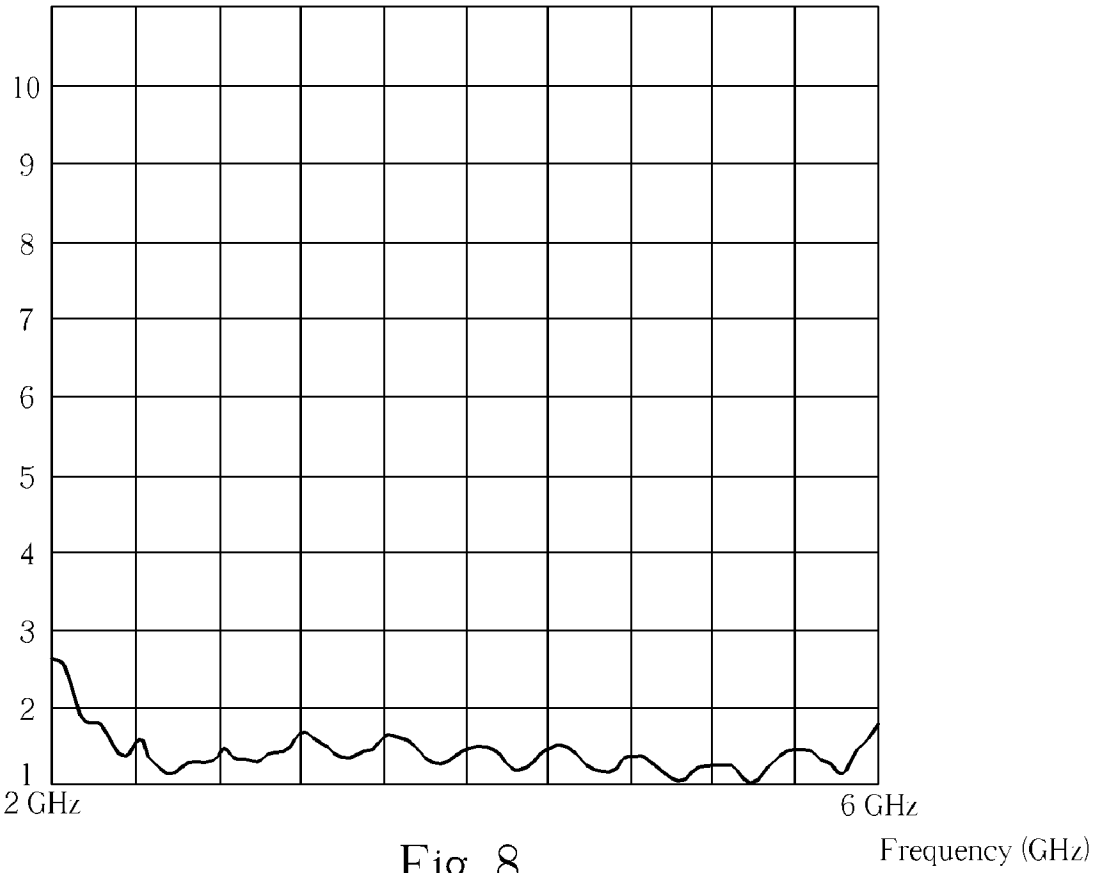
FIG. 8 is a diagram illustrating the VSWR of the wideband antenna in FIG. 7.

Please refer to FIG. 7 and FIG. 8. FIG. 7 is a diagram of a three-dimensional wideband antenna 30 according to another embodiment of the present invention. FIG. 8 is a diagram illustrating the VSWR of the wideband antenna 30 in FIG. 7. The architecture of the wideband antenna 30 is similar to the wideband antenna 10 in FIG. 1, which is a changed form of the wideband antenna 10. Please note that the difference between the two structures is that a radiator 34 of the wideband antenna 30 includes a first child radiator 35 and a second child radiator 36 each including a bend, where the amount of the bends is different from the amount of bends of the wideband antenna 20. If an angle between a first end 352 of the first child radiator 35 and the substrate 12 is still the first angle $\theta_1$, a distance between a second end 354 of the first child radiator 35 and the substrate 12 is smaller than the first height $h_1$ in FIG. 1 due to the first child radiator 35 and the second child radiator 36 each including a bend. In FIG. 8, the horizontal axis represents frequency (GHz) that distributes from 2 GHz to 6 GHz, and the vertical axis represents VSWR. Due to the wideband antenna 30 being the changed form of the wideband antenna 10 and the distance between the second end 354 of the first child radiator 35 and the substrate 12 being smaller than the first height $h_1$ in FIG. 1, the VSWR in FIG. 8 is different from the VSWR in FIG. 3 and in FIG. 4, and the different VSWRs can be applied to different system demands. Due to the amount of bends included by the wideband antenna 30 being different from the amount of bends included by the wideband antenna 20, the VSWR in FIG. 8 is different from the VSWR in FIG. 6.

Figure 9:
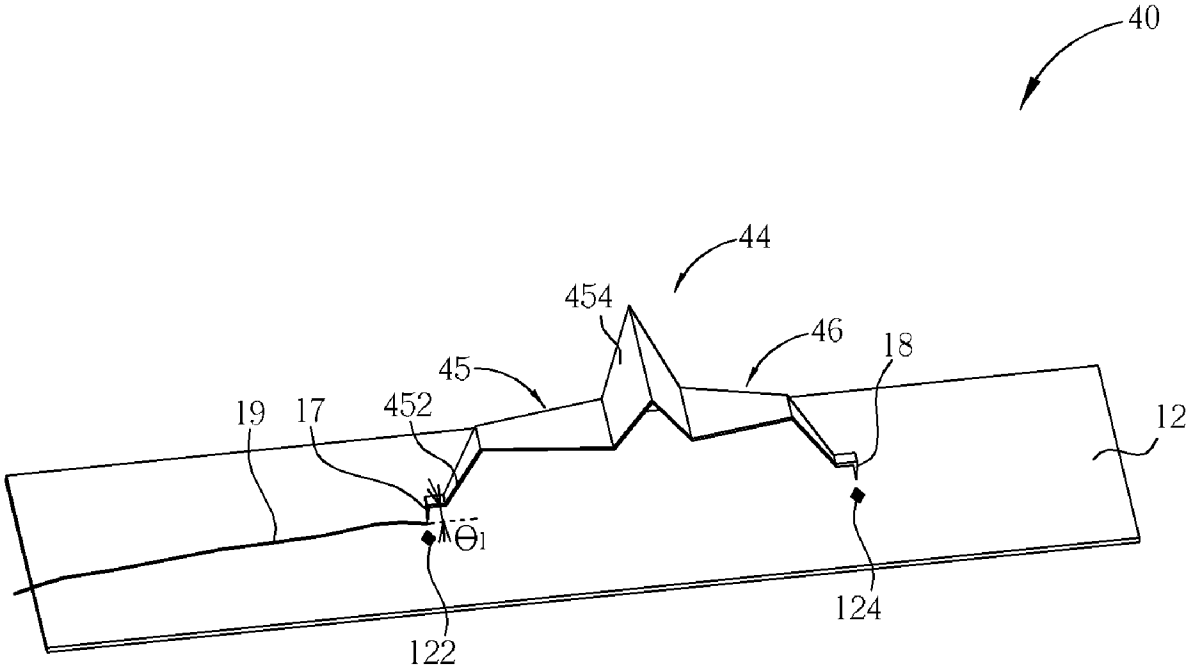
FIG. 9 is a diagram of a three-dimensional wideband antenna according to another embodiment of the present invention.
Figure 10:
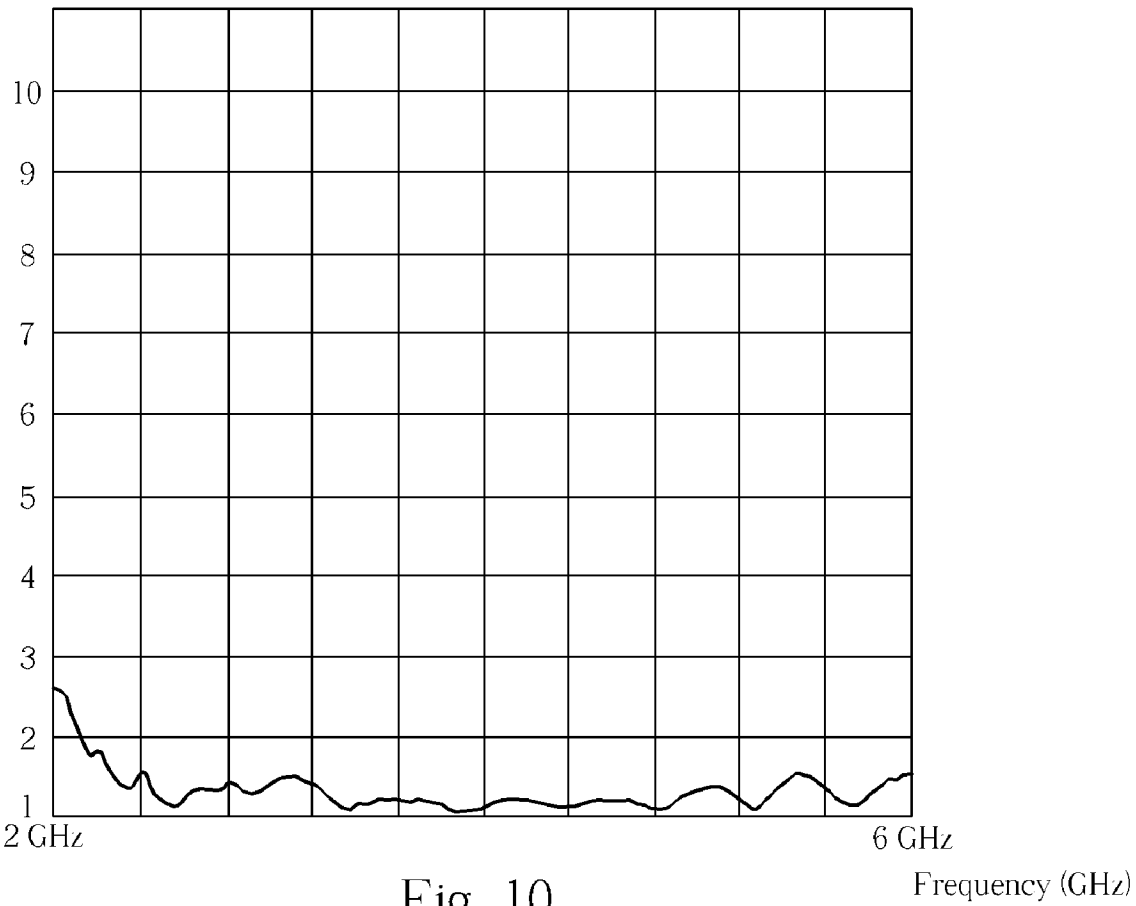
FIG. 10 is a diagram illustrating the VSWR of the wideband antenna in FIG. 9.

Please refer to FIG. 9 and FIG. 10. FIG. 9 is a diagram of a three-dimensional wideband antenna 40 according to another embodiment of the present invention. FIG. 10 is a diagram illustrating the VSWR of the wideband antenna 40 in FIG. 9. The architecture of the wideband antenna 40 is similar to the wideband antenna 10 in FIG. 1, which is a changed form of the wideband antenna 10. Please note that the difference between the two structures is that a radiator 44 of the wideband antenna 40 includes a first child radiator 45 and a second child radiator 46 each including several bends, where the amount and the shape of the bends is different from the amount and the shape of the bends of the wideband antenna 20 and 30. If an angle between a first end 452 of the first child radiator 45 and the substrate 12 is still the first angle $\theta_1$, a distance between a second end 454 of the first child radiator 45 and the substrate 12 will be smaller than the first height $h_1$ in FIG. 1 due to the first child radiator 45 and the second child radiator 46 each including several bends. In FIG. 10, the horizontal axis represents frequency (GHz) that distributes from 2 GHz to 6 GHz, and the vertical axis represents VSWR. Due to the wideband antenna 40 being the changed form of the wideband antenna 10, the VSWR in FIG. 10 is different from the VSWR in FIG. 3 and in FIG. 4, and can be applied according to different system demands. Due to the amount and the shape of bends included by the wideband antenna 40 being different from the amount and the shape of bends included by the wideband antenna 20 and 30, the VSWR in FIG. 10 is different from the VSWR in FIG. 6 and in FIG. 8.

Figure 11:
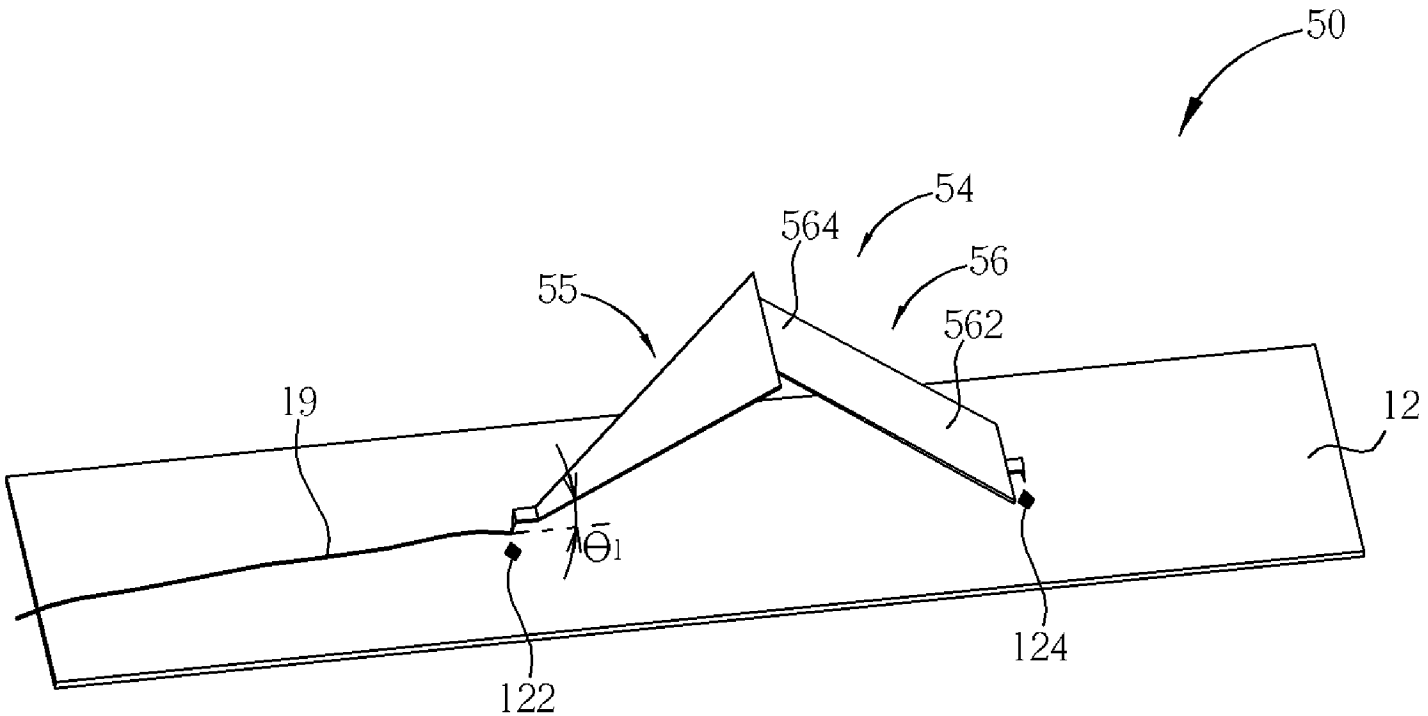
FIG. 11 is a diagram of a three-dimensional wideband antenna according to another embodiment of the present invention.

Please refer to FIG. 11, which is a diagram of a three-dimensional wideband antenna 50 according to another embodiment of the present invention. A radiator 54 of the wideband antenna 50 includes a first child radiator 55 and a second child radiator 56, a difference between the wideband antenna 50 and the wideband antenna 10 in FIG. 1 being that the second child radiator 56 of the wideband antenna 50 is approximately a rectangle, and a width of a first end 562 and a width of a second end 564 is not restricted. Please note that this embodiment is merely used for illustration, and the shape of the second child radiator 56 can be other shapes and is not limited to the rectangle.

Figure 12:
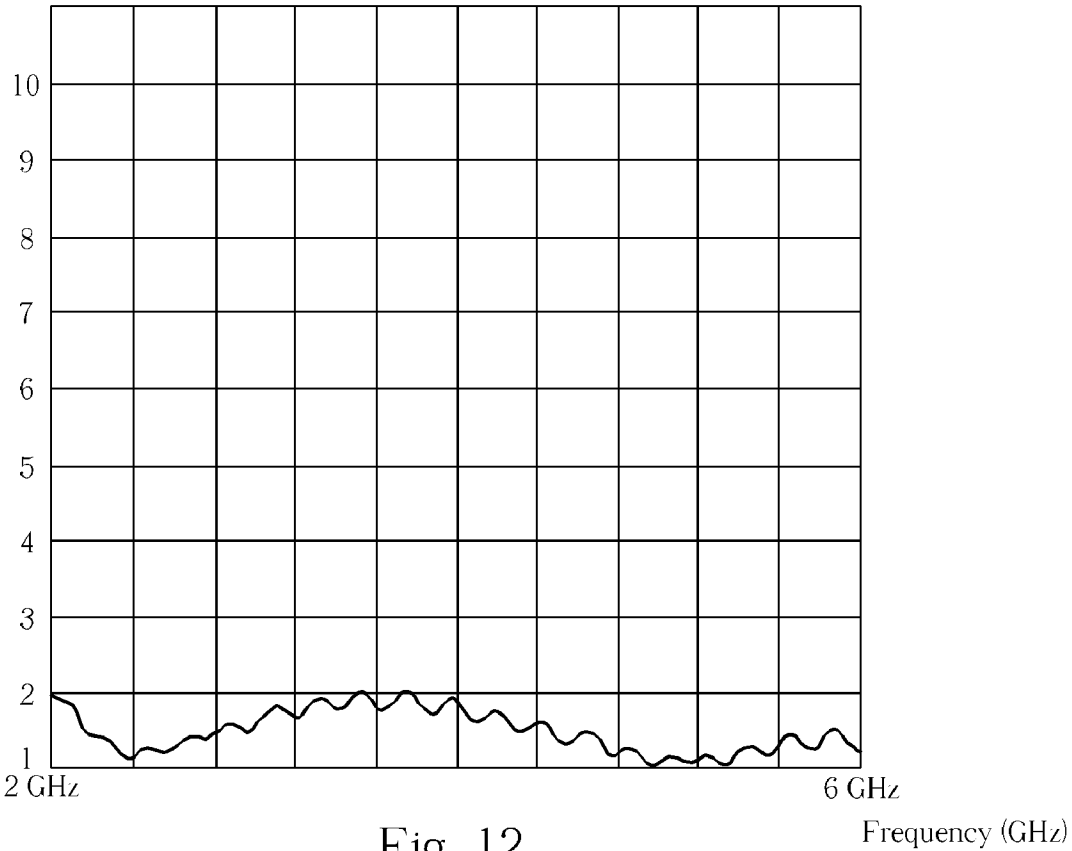
FIG. 12 is a diagram illustrating the VSWR of the wideband antenna in FIG. 1.

Please refer to FIG. 12 and FIG. 11. FIG. 12 is a diagram illustrating the VSWR of the wideband antenna 50 in FIG. 11. The horizontal axis represents frequency (GHz) that distributes from 2 GHz to 6 GHz, and the vertical axis represents VSWR. Due to the wideband antenna 50 being the changed form of the wideband antenna 10, the VSWR in FIG. 12 is different from the VSWR in FIG. 3 and in FIG. 4, and different VSWRs can be applied according to different system demands.

Figure 13:
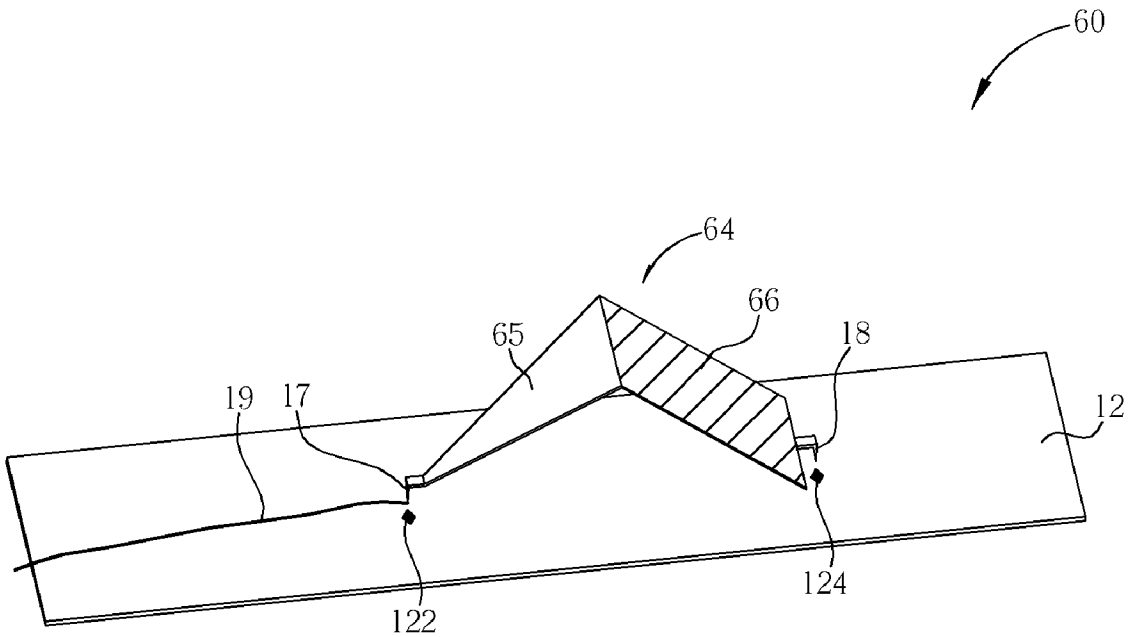
FIG. 13 is a diagram of a three-dimensional wideband antenna according to another embodiment of the present invention.

Please refer to FIG. 13, which is a diagram of a three-dimensional wideband antenna 60 according to another embodiment of the present invention. A radiator 64 of the wideband antenna 60 includes a first child radiator 65 and a second child radiator 66, a difference between the wideband antenna 60 and the wideband antenna 10 in FIG. 1 being that the second child radiator 66 of the wideband antenna 60 is a conductor paste, and the second child radiator 66 and the first child radiator 65 are not formed by a single metal sheet. Please note that the embodiment is merely used for illustration, and the shape and the material of the second child radiator 66 are not limited and can be other shapes or other materials.

Figure 14:
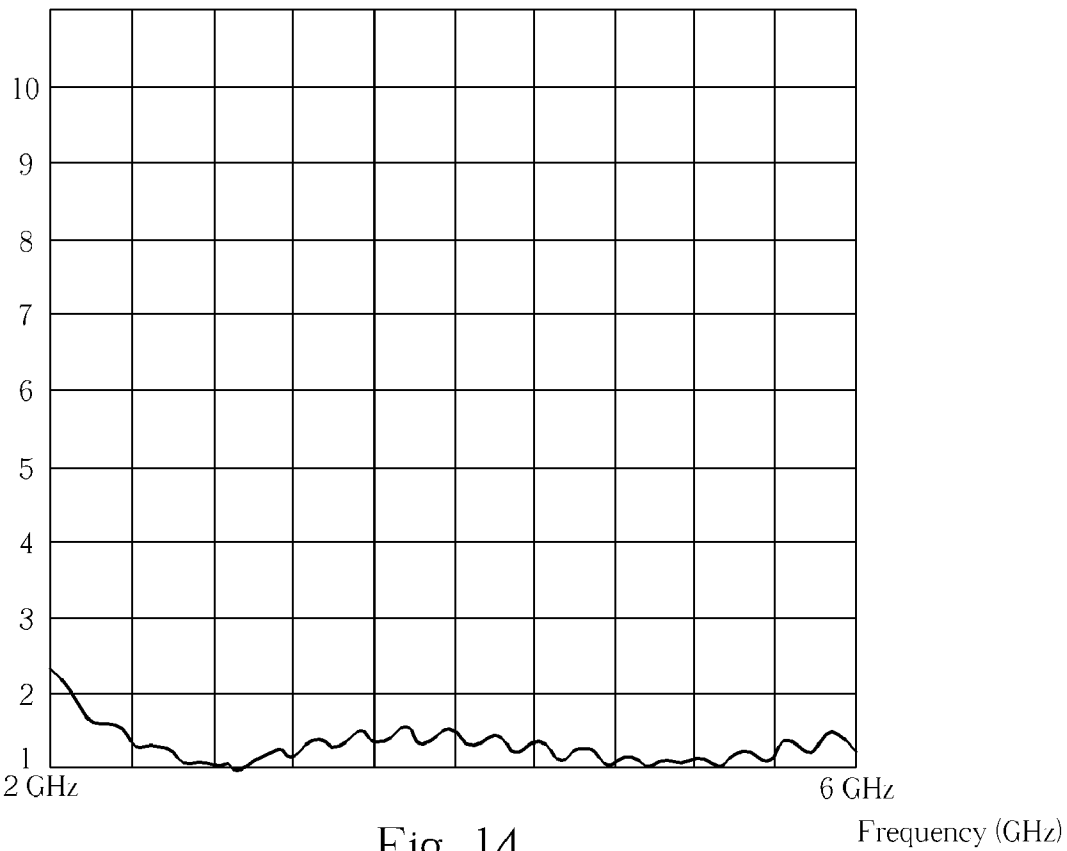
FIG. 14 is a diagram illustrating the VSWR of the wideband antenna in FIG. 13.

Please refer to FIG. 14 and FIG. 13. FIG. 14 is a diagram illustrating the VSWR of the wideband antenna 60 in FIG. 13. The horizontal axis represents frequency (GHz) that distributes from 2 GHz to 6 GHz, and the vertical axis represents VSWR. Due to the wideband antenna 60 being the changed form of the wideband antenna 10, the VSWR in FIG. 14 is different from the VSWR in FIG. 3 and in FIG. 4, and the different VSWRs can be applied according to different system demands.

Figure 15:
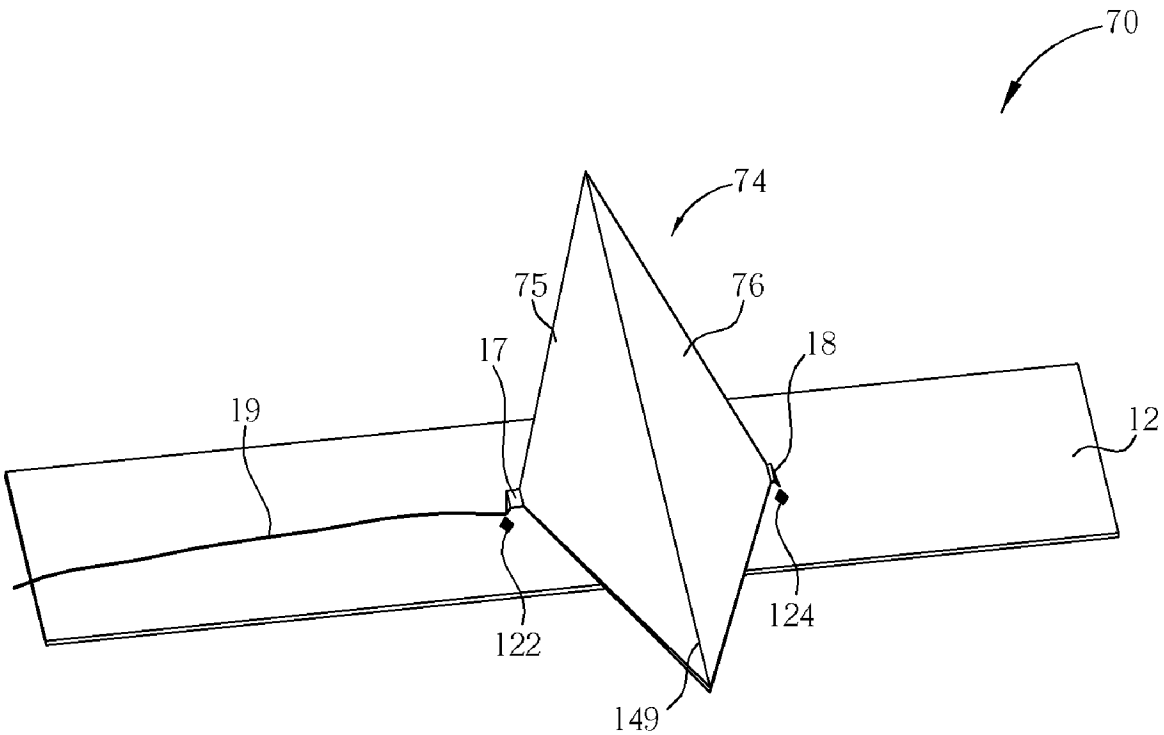
FIG. 15 is a diagram of a three-dimensional wideband antenna according to another embodiment of the present invention.

Please refer to FIG. 15, FIG. 1, and FIG. 2. FIG. 15 is a diagram of a three-dimensional wideband antenna 70 according to another embodiment of the present invention. A radiator 74 of the wideband antenna 70 includes a first child radiator 75 and a second child radiator 76, a difference between the wideband antenna 70 and the wideband antenna 10 in FIG. 1 being that the first child radiator 75 and the second child radiator 76 are formed by bending the rhombus metal sheet along another diagonal 149 of the rhombus metal sheet. At this time, the first interior angle $\phi_1$ is greater than 90 degrees and the second interior angle $\phi_2$ is smaller than 90 degrees. Please note that the embodiment is merely used for illustration, and the first interior angle $\phi_1$ and the second interior angle $\phi_2$ are not limited to fixed values.

Figure 16:
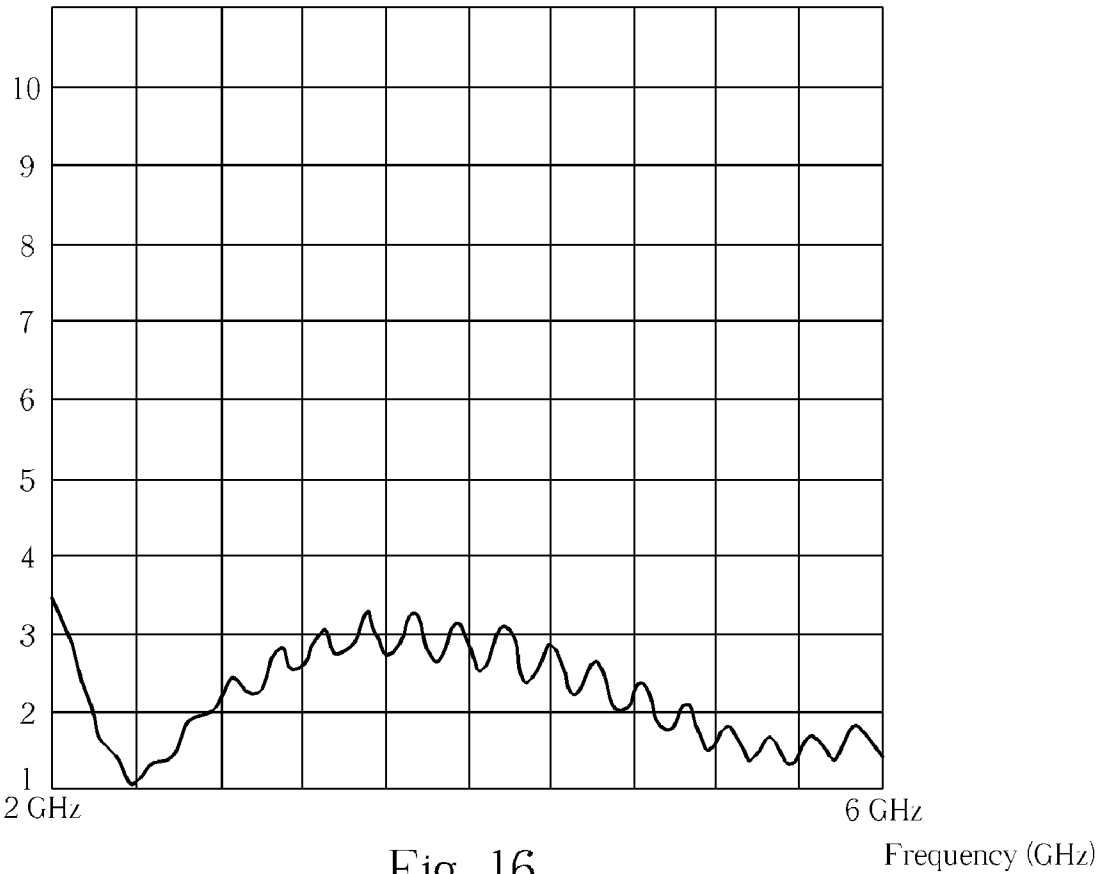
FIG. 16 is a diagram illustrating the VSWR of the wideband antenna in FIG. 15.

Please refer to FIG. 16 and FIG. 15. FIG. 16 is a diagram illustrating the VSWR of the wideband antenna 70 in FIG. 15. The horizontal axis represents frequency (GHz) that distributes from 2 GHz to 6 GHz, and the vertical axis represents VSWR. Due to the wideband antenna 70 being the changed form of the wideband antenna 10, the VSWR in FIG. 16 is different from the VSWR in FIG. 3 and in FIG. 4, and the different VSWRs can be applied according to different system demands.

Figure 17:
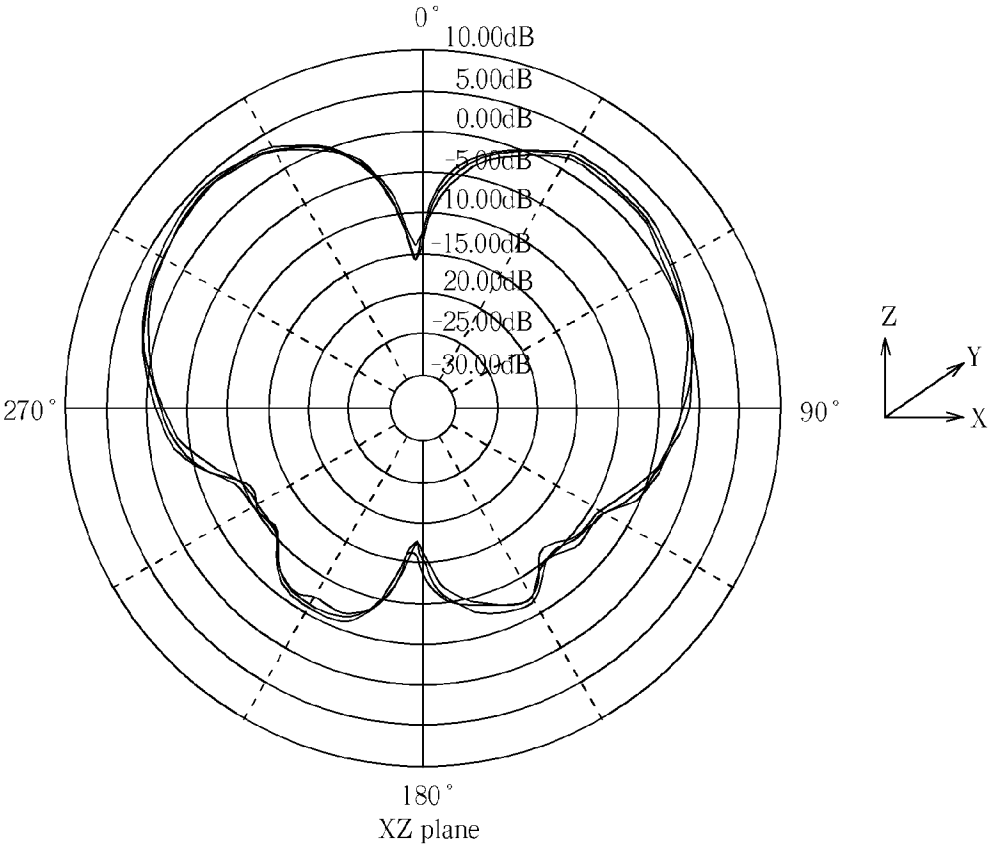
FIG. 17 is a diagram of a radiation pattern of the wideband antenna in FIG. 1.

Please refer to FIG. 17 and FIG. 18. FIG. 17 is a diagram of a radiation pattern of the wideband antenna 10 in FIG. 1. FIG. 17 represents measuring results of the wideband antenna 10 in the XZ plane, which has an operational frequency of 2 GHz. FIG. 18 is a diagram showing the positions and the values of the maximum values and the minimum values in FIG. 17. As shown in FIG. 17 and FIG. 18, the positions of the maximum values approximately fall in (−45°), having an approximate value range of 3.92 dB~4.31 dB. The positions of the minimum values approximately fall in (−175°), having a value of about (−17 dB). It can be seen from the measuring results that the wideband antenna 10 in (+60°~−60°) of the XZ plane forms a radiation pattern with higher radiation efficiency, which can satisfy operational demands of wireless LAN systems.

Figure 19:
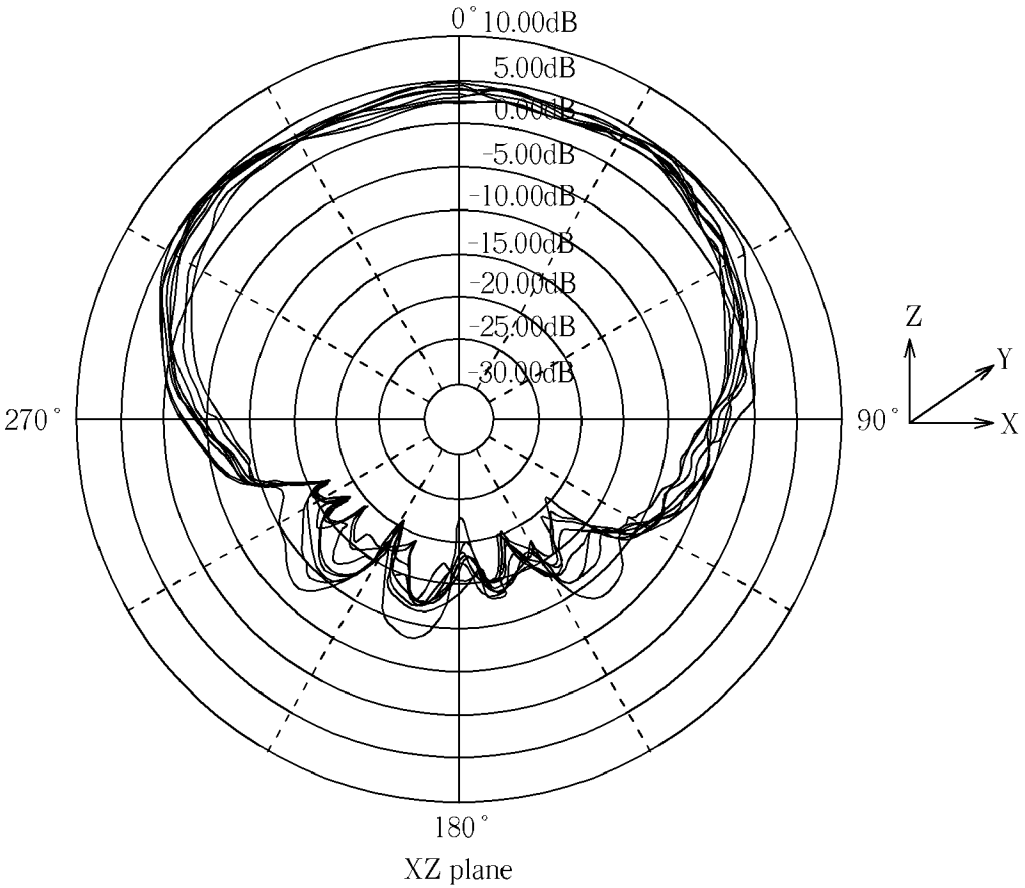
FIG. 19 is a diagram of a radiation pattern of the wideband antenna in FIG. 1.

Please refer to FIG. 19 and FIG. 20. FIG. 19 is a diagram of a radiation pattern of the wideband antenna 10 in FIG. 1. FIG. 19 represents measuring results of the wideband antenna 10 in the XZ plane, which has an operational frequency of 5 GHz. FIG. 20 is a diagram showing the positions and the values of the maximum values and the minimum values in FIG. 19. As shown in FIG. 19 and FIG. 20, the positions of the maximum values approximately fall in (−45°) and (3°), which have an approximate value range of about 4.45 dB~5.64 dB. The positions of the minimum values approximately fall in (−150°~−180°) and (132°~177°), which have a value of about (−20 dB). It can be seen from the measuring results that the wideband antenna 10 in (+60°~−60°) of the XZ plane forms a radiation pattern with higher radiation efficiency, which can satisfy operational demands of wireless LAN systems.

Thus it can be seen from the abovementioned embodiments that the operational frequency and the radiation patterns of the wideband antenna 10 can be adjusted by changing the first angle $\theta_1$ and the first height $h_1$. For example, the operational frequency and the radiation patterns of the wideband antenna 10 can be changed by adding bends, formed by changing the shape or the material of the second child radiator 16.

Figure 21:
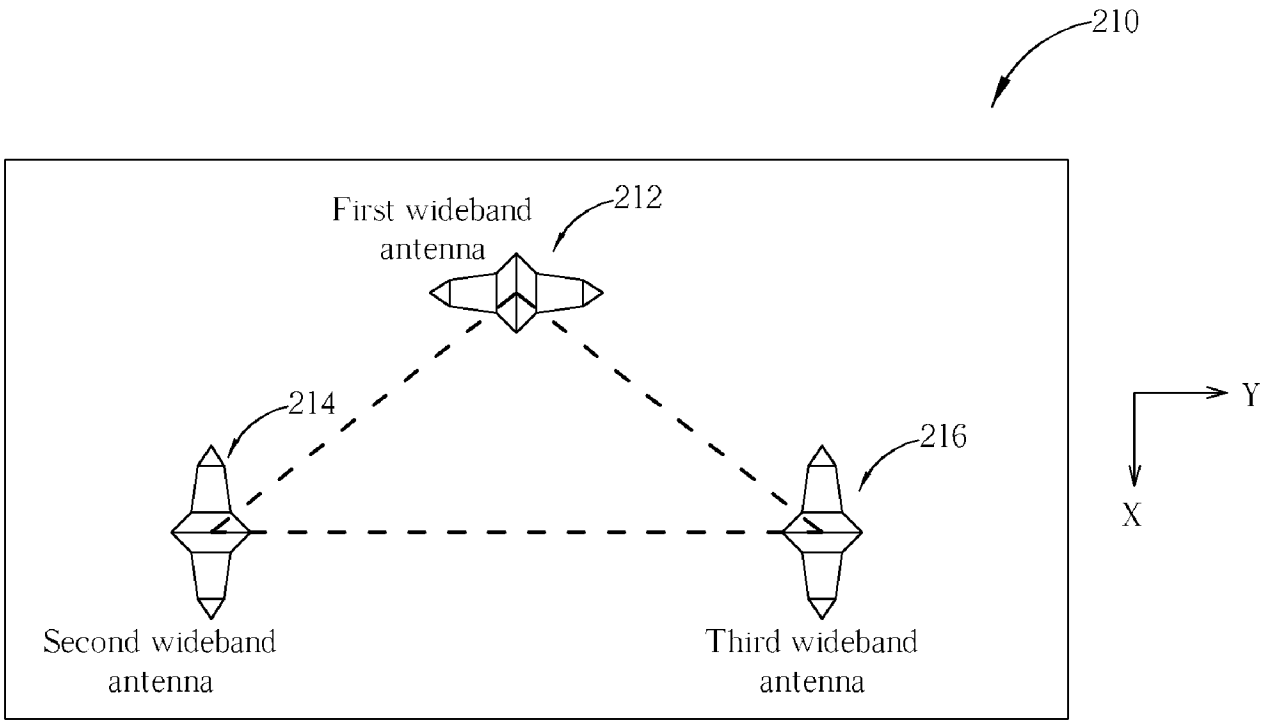
FIG. 21 is a diagram of a wireless communication device with three-dimensional wideband antennas according to an embodiment of the present invention.

Please refer to FIG. 21. FIG. 21 is a diagram of a wireless communication device 210 with three-dimensional wideband antennas according to an embodiment of the present invention. The wireless communication device 210 includes a system circuit (not shown in FIG. 21), a first wideband antenna 212, a second wideband antenna 214, and a third wideband antenna 216. The first wideband antenna 212, the second wideband antenna 214, and the third wideband antenna 216 are connected to the system circuit, and each wideband antenna is the abovementioned wideband antenna 10 or one of the changed forms. An arrangement manner of the first wideband antenna 212, the second wideband antenna 214, and the third wideband antenna 216 located inside the wireless communication device 210 is a connection line of three center points of the three wideband antennas forming a triangle. The wireless communication device 210 is a wireless access point (WAP).

Figure 22:
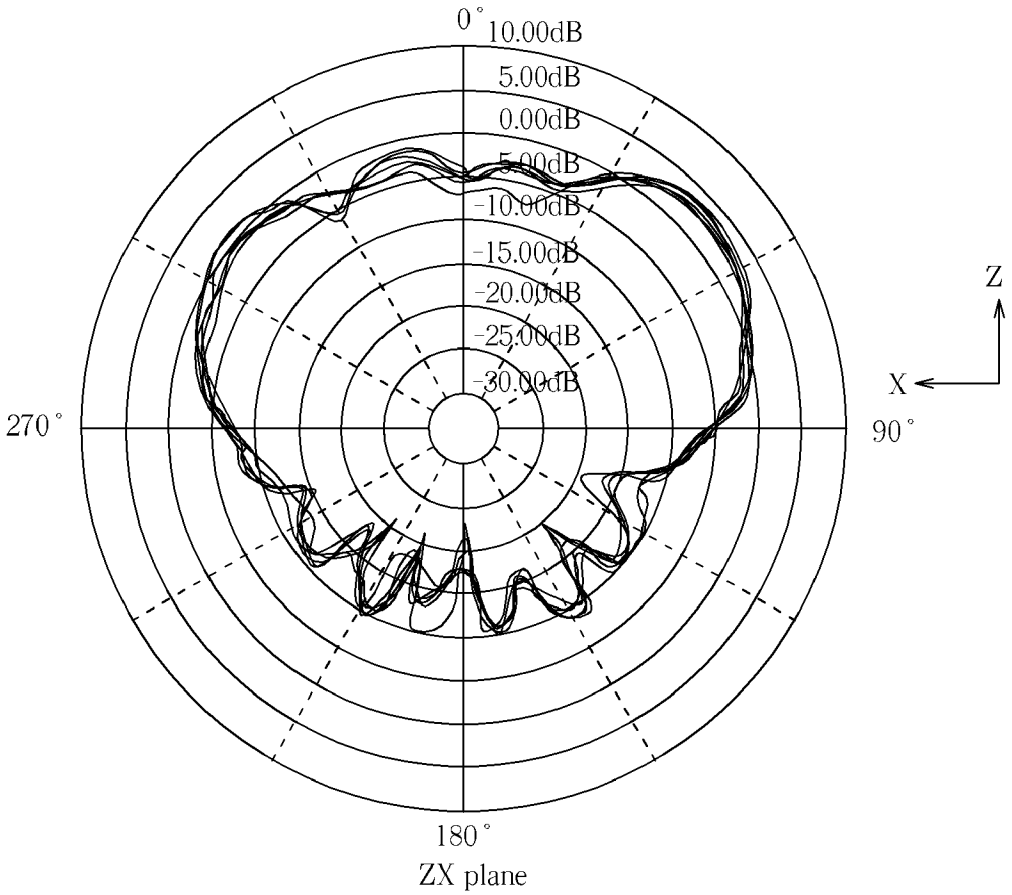
FIG. 22 is a diagram of a radiation pattern of the first wideband antenna in FIG. 21.
Figure 23:
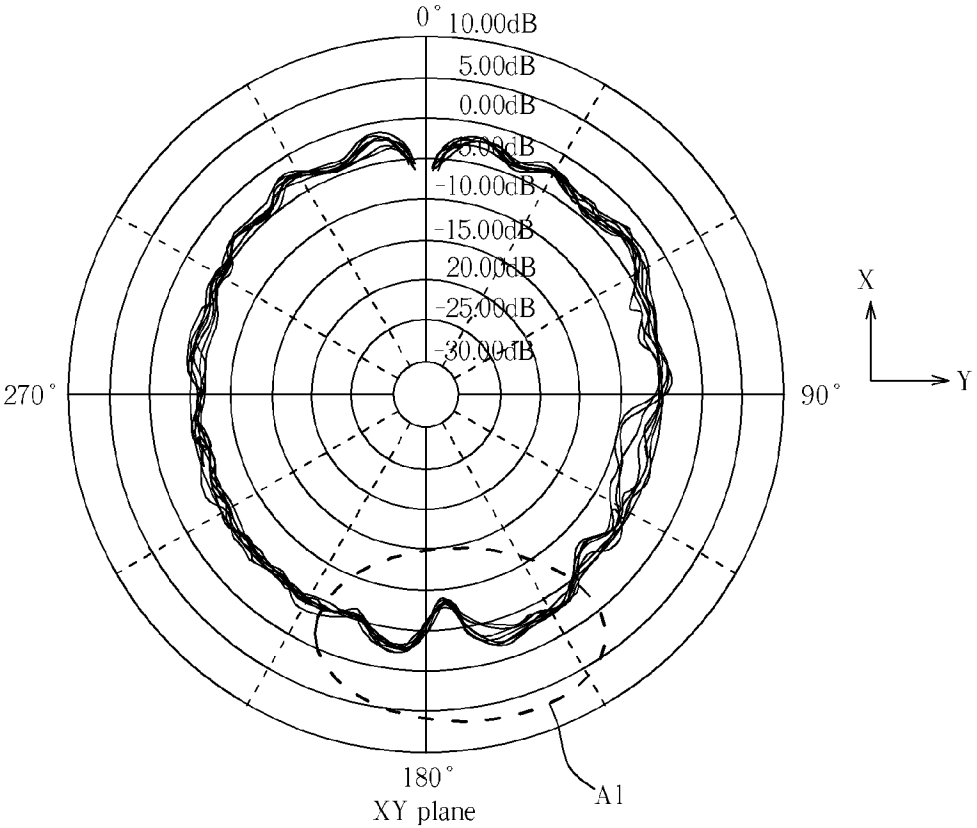
FIG. 23 is a diagram of a radiation pattern of the first wideband antenna in FIG. 21.

Please refer to FIG. 22 and FIG. 23. FIG. 22 and FIG. 23 are both diagrams of a radiation pattern of the first wideband antenna 212 in FIG. 21. FIG. 22 represents measuring results of the first wideband antenna 212 in the ZX plane, and FIG. 23 represents measuring results of the first wideband antenna 212 in the XY plane. Thus it can be seen from the measuring results that the cover range of the radiation pattern in the ZX plane is very large, with most falling between (−75°) and (75°). Furthermore, the characteristic of the radiation pattern in the XY plane is that it has a small hollow, as marked in a portion A1.

Figure 24:
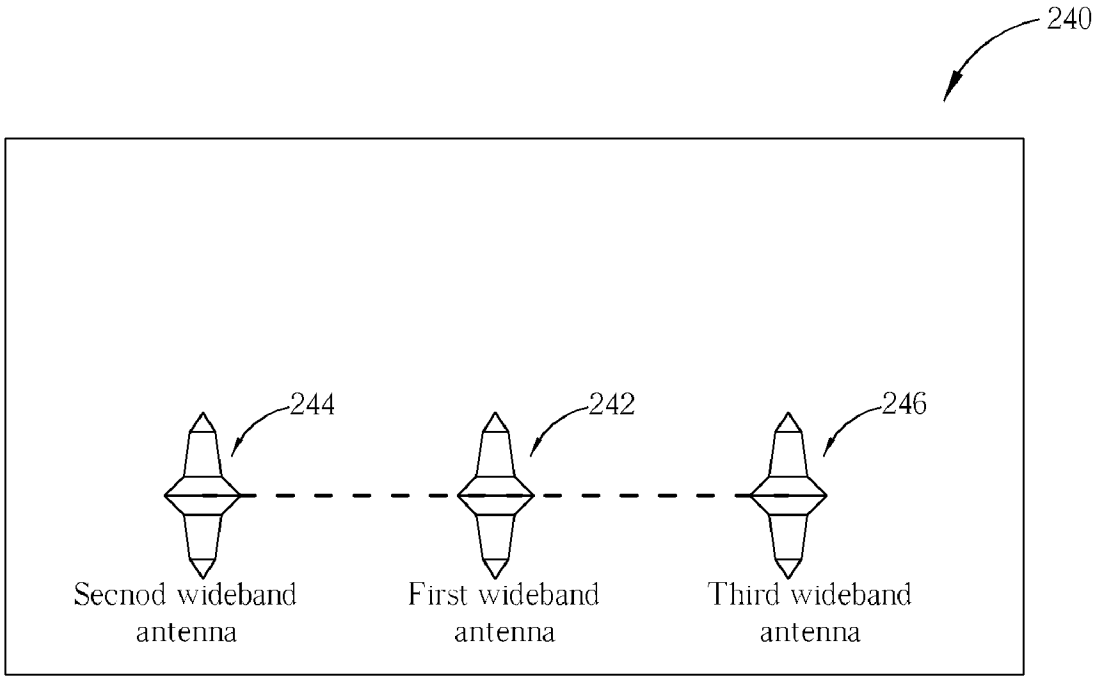
FIG. 24 is a diagram of a wireless communication device with three-dimensional wideband antennas according to an embodiment of the present invention.

Please refer to FIG. 24. FIG. 24 is a diagram of a wireless communication device 240 with three-dimensional wideband antennas according to an embodiment of the present invention. The wireless communication device 240 includes a system circuit (not shown in FIG. 24), a first wideband antenna 242, a second wideband antenna 244, and a third wideband antenna 246. The first wideband antenna 242, the second wideband antenna 244, and the third wideband antenna 246 are connected to the system circuit, and each wideband antenna is the abovementioned wideband antenna 10 or one of the changed forms. Please note that a difference between the wireless communication device 240 and the wireless communication device 210 is that an arrangement manner of the first wideband antenna 242, the second wideband antenna 244, and the third wideband antenna 246 located inside the wireless communication device 240 is a connection line of three center points of the three wideband antennas forming a straight line. The wireless communication device 240 is a wireless access point (WAP).

Figure 25:
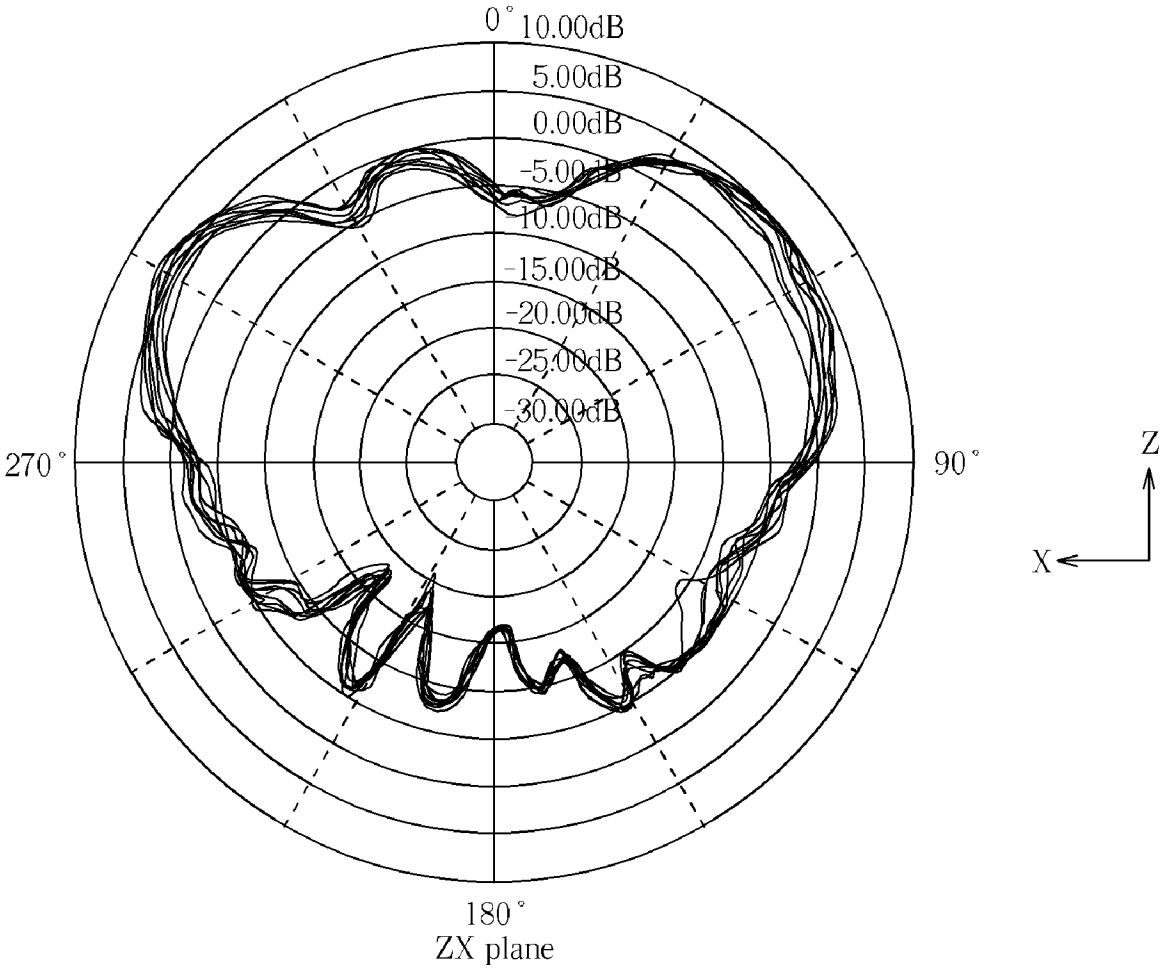
FIG. 25 is a diagram of a radiation pattern of the first wideband antenna in FIG. 24.
Figure 26:
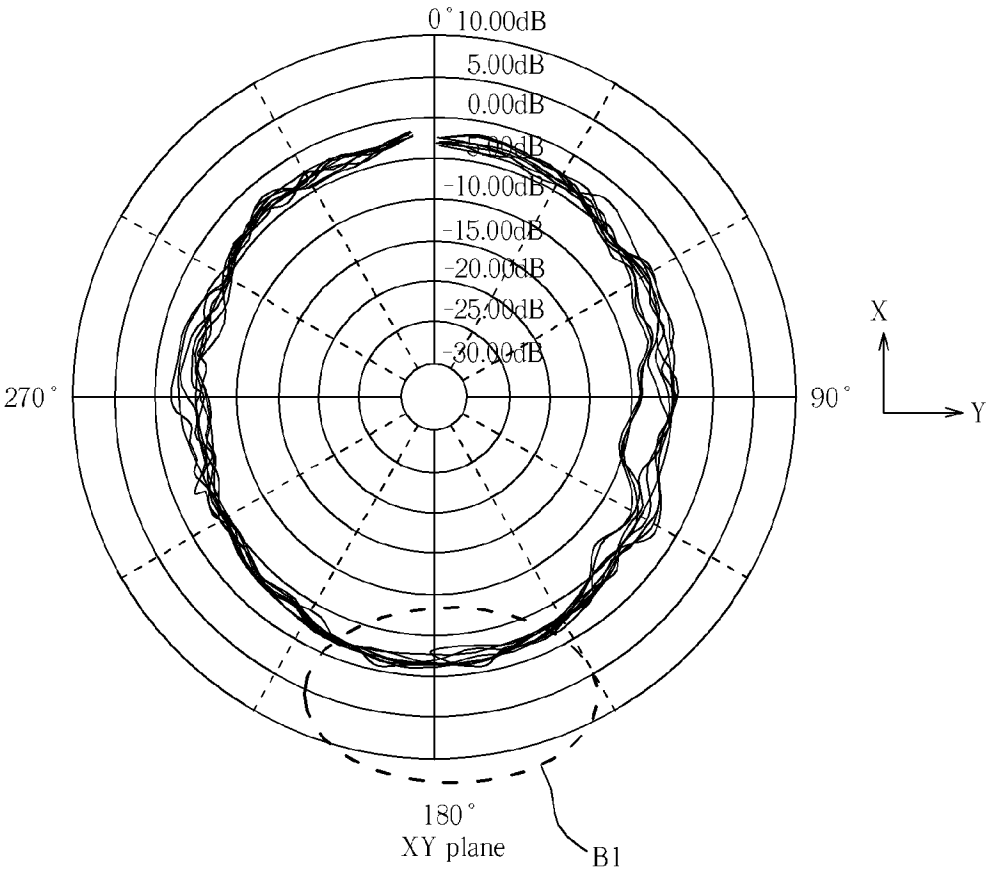
FIG. 26 is a diagram of a radiation pattern of the first wideband antenna in FIG. 24.

Please refer to FIG. 25 and FIG. 26. FIG. 25 and FIG. 26 are both diagrams of a radiation pattern of the first wideband antenna 242 in FIG. 24. FIG. 25 represents measuring results of the first wideband antenna 242 in the ZX plane, and FIG. 26 represents measuring results of the first wideband antenna 242 in the XY plane. Thus it can be seen from the measuring results that the cover range of the radiation pattern in the ZX plane is very large, with most falling between (−75°) and (75°). Furthermore, the characteristic of the radiation pattern in the XY plane is that it has no small hollow, as marked in a portion B1. The small hollow of the first wideband antenna 242 in the radiation pattern in the XY plane disappears due to compression effects caused by the second wideband antenna 244 and the third wideband antenna 246.

The above-mentioned embodiments are presented merely to describe the present invention, and in no way should be considered to be limitations of the scope of the present invention. The abovementioned wideband antenna 10 may include several changed forms, for example, the wideband antennas 20, 30, and 40 are generated by adding a certain amount of bends of the first child radiator 15 and the second child radiator 16, the wideband antenna 50 is generated by changing the shape of the second child radiator 56, and the wideband antenna 60 is generated by changing the material of the second child radiator 66. Therefore, the operational frequency and the radiation patterns of the wideband antenna 10 will be changed. However, the wideband antennas 10~70 are merely used for illustration and should not be restricted. Furthermore, the operational frequency and the radiation patterns of the wideband antenna 10 can be adjusted by changing the first angle $\theta_1$, the first height $h_1$, and the second height $h_2$. The first angle $\theta_1$, the first height $h_1$, the second height $h_2$, the first length $L_1$, the first interior angle $\phi_1$, and the second interior angle $\phi_2$ are not limited to fixed values only and can be adjusted depending on user's demands. The amount of the antennas installed in the wireless communication device 210 and the wireless communication device 240 is not limited to be three only and can be other amounts.

From the above descriptions, the present invention provides wideband antennas 10~70 and related wireless communication devices 210 and 240 utilizing a rhombus metal sheet (as well as its changed forms) with an inverted V-shape installed on a substrate. The VSWR, the operational frequency, and the radiation patterns of the wideband antennas can be adjusted by changing parameters such as the first angle $\theta_1$, the first height $h_1$, the second height $h_2$, the first length $L_1$, the first interior angle $\phi_1$, and the second interior angle $\phi_2$. Through the wideband antenna disclosed in the present invention, not only the operational frequency and the radiation patterns can be controlled to conform to demands for wireless communication system, but manufacturing cost can also be effectively saved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A three-dimensional wideband antenna comprising:

a substrate comprising a signal feeding point and a grounding point;

a radiator installed on the substrate, the radiator comprising:

a first child radiator having a first end and a second end; and a second child radiator having a first end and a second end, the second end of the second child radiator connected to the second end of the first child radiator;

a signal feeding element connected between the signal feeding point and the first end of the first child radiator; and a grounding element connected between the grounding point and the first end of the second child radiator;

wherein the first child radiator and the second child radiator form an inverted V-shape installed on the substrate.

2. The wideband antenna of claim 1, wherein the substrate comprises dielectric material.

3. The wideband antenna of claim 1, wherein the substrate is connected to a system ground terminal electrically.

4. The wideband antenna of claim 1, wherein the first child radiator approximates to a tapered width plane, and a width of the first end of the first child radiator is smaller than a width of the second end of the first child radiator.

5. The wideband antenna of claim 1, wherein the first child radiator comprises a plurality of bends.

6. The wideband antenna of claim 1, wherein the second child radiator approximates to a tapered width plane, and a width of the first end of the second child radiator is smaller than a width of the second end of the second child radiator.

7. The wideband antenna of claim 1, wherein the second child radiator approximates to a rectangle.

8. The wideband antenna of claim 1, wherein the second child radiator is a conductor paste.

9. The wideband antenna of claim 1, wherein the second child radiator comprises a plurality of bends.

10. The wideband antenna of claim 1, wherein the first child radiator and the second child radiator are substantially composed of a single metal sheet.

11. The wideband antenna of claim 1, wherein the first child radiator and the second child radiator are formed by bending a rhombus metal sheet along a diagonal of the rhombus metal sheet.

12. The wideband antenna of claim 11, wherein an edge length of the rhombus metal sheet is approximately one quarter of a wavelength of a resonance mode generated by the wideband antenna.

13. The wideband antenna of claim 1, wherein the wideband antenna is installed in a wireless communication device.

14. The wideband antenna of claim 13, wherein the wireless communication device is a wireless access point (WAP).

15. A wireless communication device with three-dimensional wideband antennas, the wireless communication device comprising:

a system circuit; and a plurality of wideband antennas connected to the system circuit, each wideband antenna comprising:

a substrate comprising a signal feeding point and a grounding point;

a radiator installed on the substrate, the radiator comprising:

a first child radiator having a first end and a second end; and a second child radiator having a first end and a second end, the second end of the second child radiator connected to the second end of the first child radiator;

a signal feeding element connected between the signal feeding point and the first end of the first child radiator; and a grounding element connected between the grounding point and the first end of the second child radiator;

wherein the first child radiator and the second child radiator form an inverted V-shape installed on the substrate.

16. The wireless communication device of claim 15, wherein the substrate comprises dielectric material.

17. The wireless communication device of claim 15, wherein the substrate is connected to a system ground terminal electrically.

18. The wireless communication device of claim 15, wherein the first child radiator approximates to a tapered width plane, and a width of the first end of the first child radiator is smaller than a width of the second end of the first child radiator.

19. The wireless communication device of claim 15, wherein the first child radiator comprises a plurality of bends.

20. The wireless communication device of claim 15, wherein the second child radiator approximates to a tapered width plane, and a width of the first end of the second child radiator is smaller than a width of the second end of the second child radiator.

21. The wireless communication device of claim 15, wherein the second child radiator approximates to a rectangle.

22. The wireless communication device of claim 15, wherein the second child radiator is a conductor paste.

23. The wireless communication device of claim 15, wherein the second child radiator comprises a plurality of bends.

24. The wireless communication device of claim 15, wherein the first child radiator and the second child radiator are substantially composed of a single metal sheet.

25. The wireless communication device of claim 15, wherein the first child radiator and the second child radiator are formed by bending a rhombus metal sheet along a diagonal of the rhombus metal sheet.

26. The wireless communication device of claim 25, wherein an edge length of the rhombus metal sheet is approximately one quarter of a wavelength of a resonance mode generated by the wideband antenna.

27. The wireless communication device of claim 15, wherein the wireless communication device is a wireless access point (WAP).

28. The wireless communication device of claim 15, wherein an amount of the antennas is three.

29. The wireless communication device of claim 28, wherein the wireless communication device comprises a first wideband antenna, a second wideband antenna, and a third wideband antenna, and an arrangement manner of the first wideband antenna, the second wideband antenna, and the third wideband antenna located inside the wireless communication device is a connection line of three center points of the three wideband antennas forming a triangle.

30. The wireless communication device of claim 28, wherein the wireless communication device comprises a first wideband antenna, a second wideband antenna, and a third wideband antenna, and an arrangement manner of the first wideband antenna, the second wideband antenna, and the third wideband antenna located inside the wireless communication device is a connection line of three center points of the three wideband antennas forming a straight line.

* * * * *